US006949009B1

(12) United States Patent
Gardzinski et al.

(10) Patent No.: US 6,949,009 B1
(45) Date of Patent: Sep. 27, 2005

(54) ROTATING KILN TIRE REFINISHING MACHINE

(75) Inventors: Martin A. Gardzinski, Red Wing, MN (US); Donato L. Ricci, W8477-162nd Ave., Hager City, WI (US) 54014

(73) Assignee: Donato L. Ricci, Hager City, WI (US)

( * ) Notice: Subject to any disclaimer, the term of this patent is extended or adjusted under 35 U.S.C. 154(b) by 0 days.

(21) Appl. No.: 10/959,658

(22) Filed: Oct. 6, 2004

(51) Int. Cl.[7] ..... B24B 49/00

(52) U.S. Cl. ..... 451/14; 451/24; 451/310

(58) Field of Search ..... 451/14, 15, 24, 451/296, 310, 311

(56) References Cited

U.S. PATENT DOCUMENTS 3,466,808 A * 9/1969 Mess ..... 451/236
4,488,382 A * 12/1984 Zajac et al. ..... 451/26

* cited by examiner

*Primary Examiner*—Jacob K. Ackun, Jr.
(74) *Attorney, Agent, or Firm*—Nikolai & Mersereau, P.A.

(57) ABSTRACT

A kiln tire grinder for grinding an out-of-round kiln tire comprising a grinding belt head assembly having a rotatable grinding belt and an x-y positioning table for positioning the rotating grinding belt assembly against a kiln tire. The rotating grinding belt assembly includes a drive assembly for rotating the grinding belt and a frame assembly for urging the grinding belt against the out-of-round kiln tire. The operator adjusts the rotating grinding belt head assembly against the out-of-round tire and then engages a drive motor which rotates the grinding belt. The rotating grinding belt is then urged against the kiln tire with a pressure that is adjustably controlled.

6 Claims, 4 Drawing Sheets

ROTATING KILN TIRE REFINISHING MACHINE

BACKGROUND OF THE INVENTION

The present invention relates to an apparatus for refinishing an out-of-round kiln tire and, more particularly, an adjustable assembly which grinds an out-of-round tire into round.

A rotary kiln is a rotating hollow cylinder or shell of a relatively large diameter mounted on rollers tipped at an incline. Heat is introduced into the cylinder where it is used for incinerating, drying, curing or heat treating materials in a continuous process. A number of raised steel ands called "tires" are typically disposed about the rotary kiln to assist in rotation of the kiln by the trunnion rollers. As a tire ages, various types of wear problems can occur. For instance, tire and trunnion roller surfaces may show severe wear. Symptoms may include pitting, spalling, vibration, uneven wear across their width dimension and rolled-over edges.

These conditions can result in serious damage and downtime to the rotary kiln. Damage can include unnecessary wear on key components and, if allowed to continue, other major and expensive problems can occur, such as premature bearing failures, damages to tire-retaining components, bases, drive components and peers and footings.

To this end, it is well-established that grinding kiln tires back into round gives them a near-new surface finish. This, in turn, reduces vibration, uneven wear and rolled-over edges. However, to successfully grind a tire on a rotary kiln, it is necessary to be able to place the grinding surface tangent to the tire, which in turn requires that the grinding apparatus be adjustable to properly grind the out-of-round tire surface. On-site personnel must be able to easily adjust the tire grinder to accommodate varying conditions.

SUMMARY OF THE INVENTION

It is the object of the present invention to provide an apparatus which is readily set-up, easily adjustable and which can be used to grind an out-of-round kiln tire back into round. In accordance with this and other objectives of the invention, there is provided a rotating grinding belt assembly which is coupled to a means of accurately positioning the rotating grinding belt against the out-of-round tire. The rotating grinding belt assembly includes a drive assembly for rotating the grinding belt and a frame assembly for urging the grinding belt against the out-of-round tire with a desired pressure therebetween. The drive assembly includes a drive motor which rotates the rotating grinding belt for grinding the out-of-round tire. The frame assembly includes a shield for housing the rotating belt, a planar backing assembly for supporting the belt and belt shield, and a drive assembly shield for housing the aforementioned drive assembly. The backing assembly includes a main post which holds the belt shield in an upright, but angled position and has an arm extending from its back surface. A first air ram extends from the end of the arm to a midpoint of the main post and a second air ram extends from a mid point of the main post to a backing bar which extends from the second air ram to a top surface of an A-frame base that is mounted over the drive motor.

A means for positioning the rotating grinding belt assembly relative to a tire to be ground includes a base plate member, a means for translating the rotating grinding belt assembly along an x-axis and a means for translating the rotating grinding belt assembly along a y-axis. The means for translating the rotating belt assembly along an x-axis is mounted on the base plate. It comprises a linear mel-mount which has an x-axis feed screw disposed on its top surface. The x-axis feed screw has an x-axis traveling nut operatively coupled to it and the x-axis traveling nut engages a x-axis saddle such that when the x-axis feed screw is rotated, the traveling nut is translated and the x-axis saddle is carried along the x-axis. Mounted to the x-axis saddle is the means for translating the rotating guide belt assembly along the y-axis. The means for translating the rotating guide belt assembly along the y-axis includes a y-axis mounting plate which has a y-axis feed screw journaled for rotation along the top surface of the y-axis mounting plate. A y-axis traveling nut is operatively coupled to the y-axis feed screw. When the y-axis feed screw is rotated, the traveling nut is engaged and is also operatively coupled to a y-axis saddle, which is then translated along the y-axis.

The operator then adjusts the rotating grinding belt assembly along the x- and y-axis so that the grinding belt is aligned with the out-of-round tire and the drive motor assembly rotates the grinding belt so that when it comes in contact with the out-of-round tire, it will grind the tire back into round. The air rams insure that a desired working pressure is maintained between the tire and the grinding belt.

BRIEF DESCRIPTION OF THE DRAWINGS

The above and other objectives and advantages of the invention will be more readily apparent from the following detailed description when considered with the accompanying drawings wherein.

DETAILED DESCRIPTION

Figure 1:
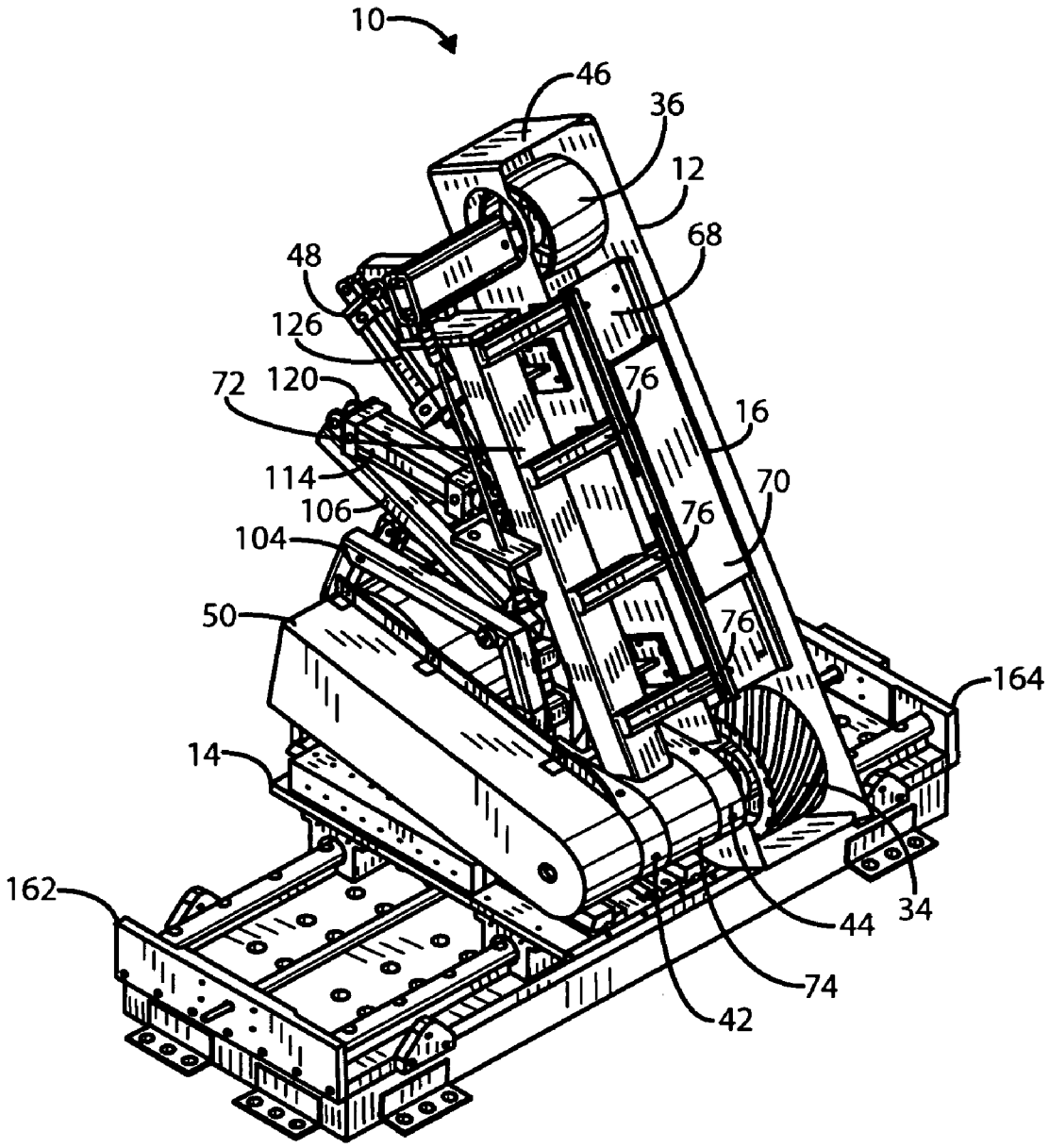
FIG. 1 is a perspective view of the kiln tire refinishing machine of the present invention.
Figure 2:
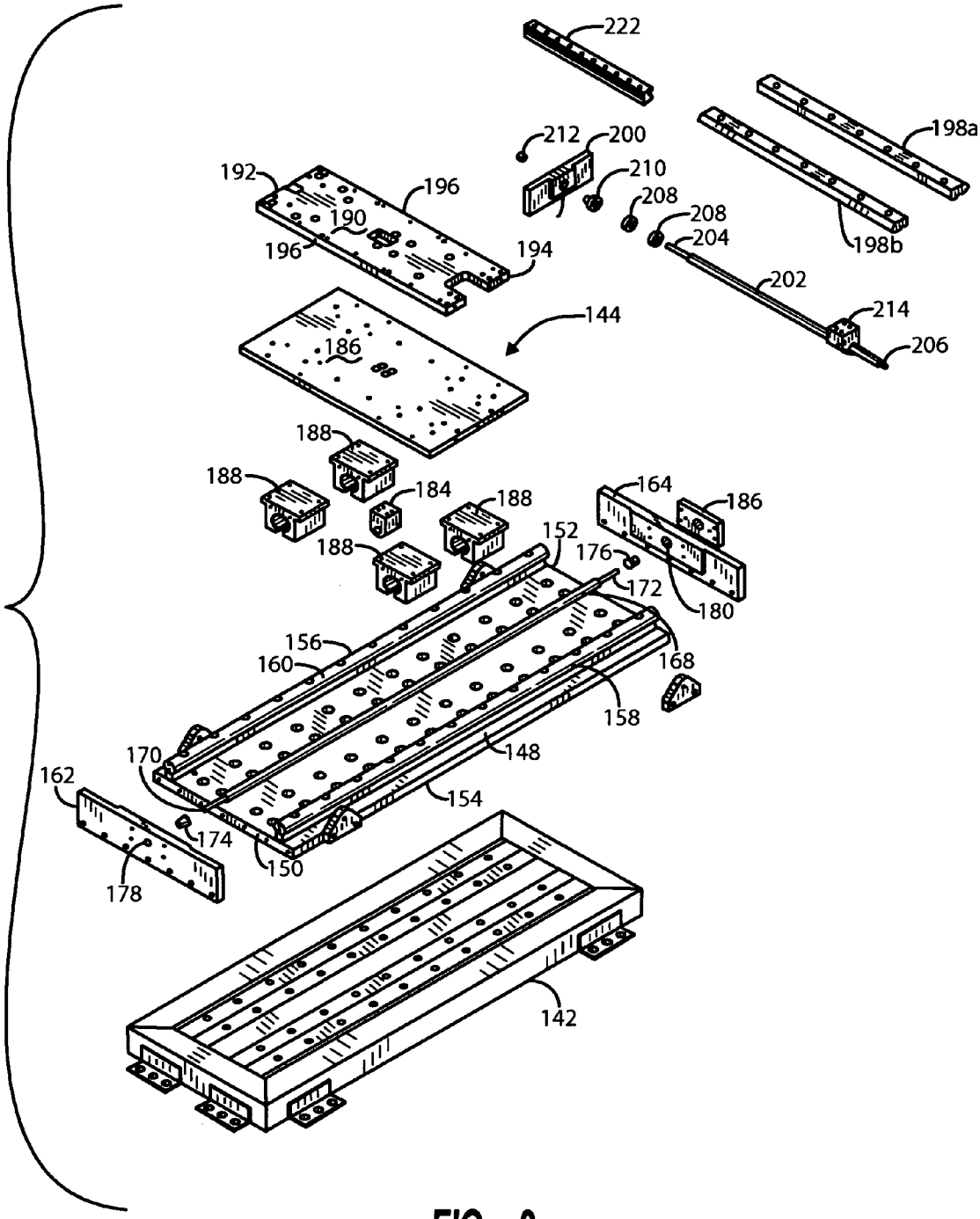
FIG. 2 is an exploded view of the x- and y-axis saddle mechanisms forming parts of the present invention.
Figure 3A:
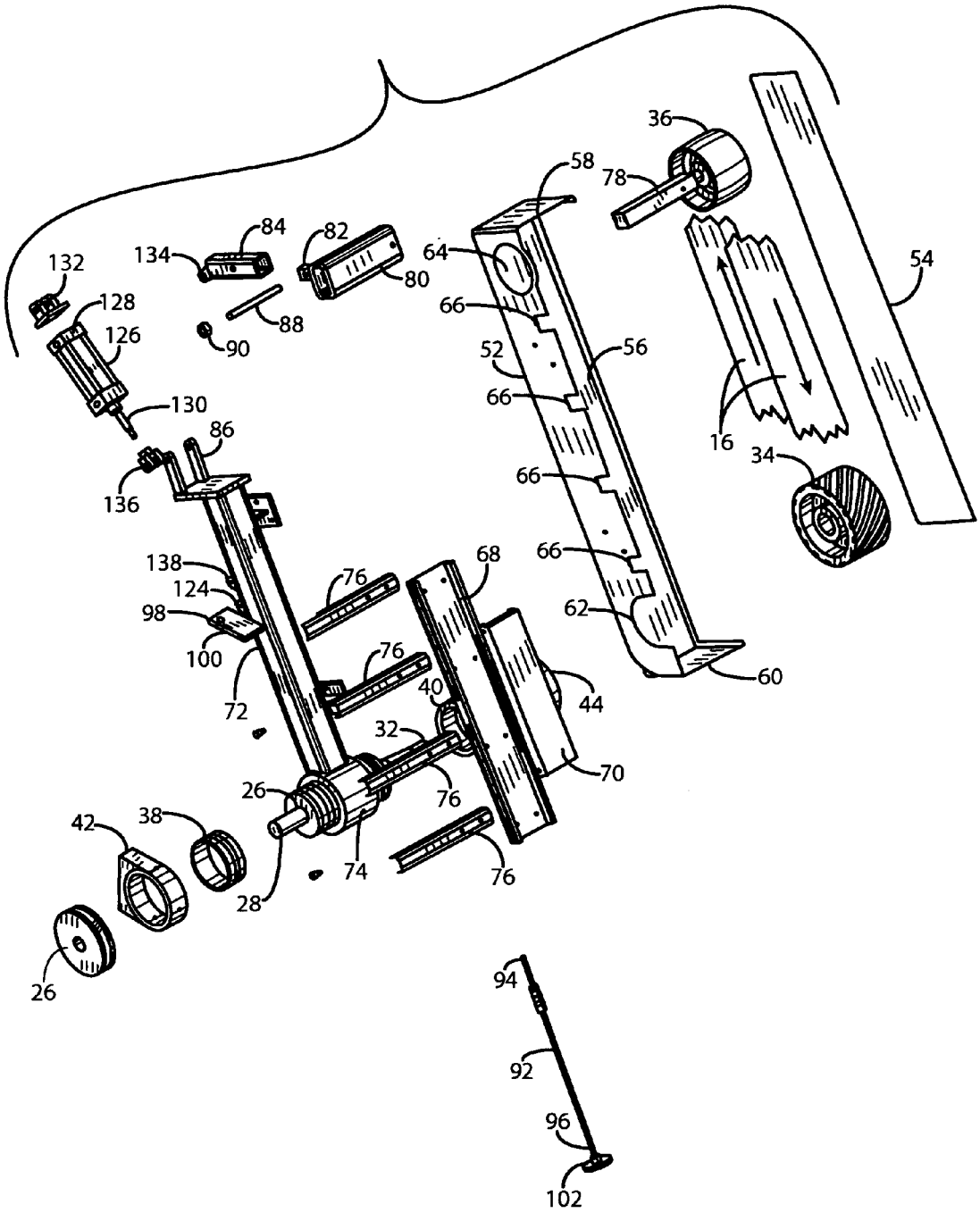
FIGS. 3(*a*) and 3(*b*) are exploded views of the grinder mechanism of the present invention.
Figure 3B:
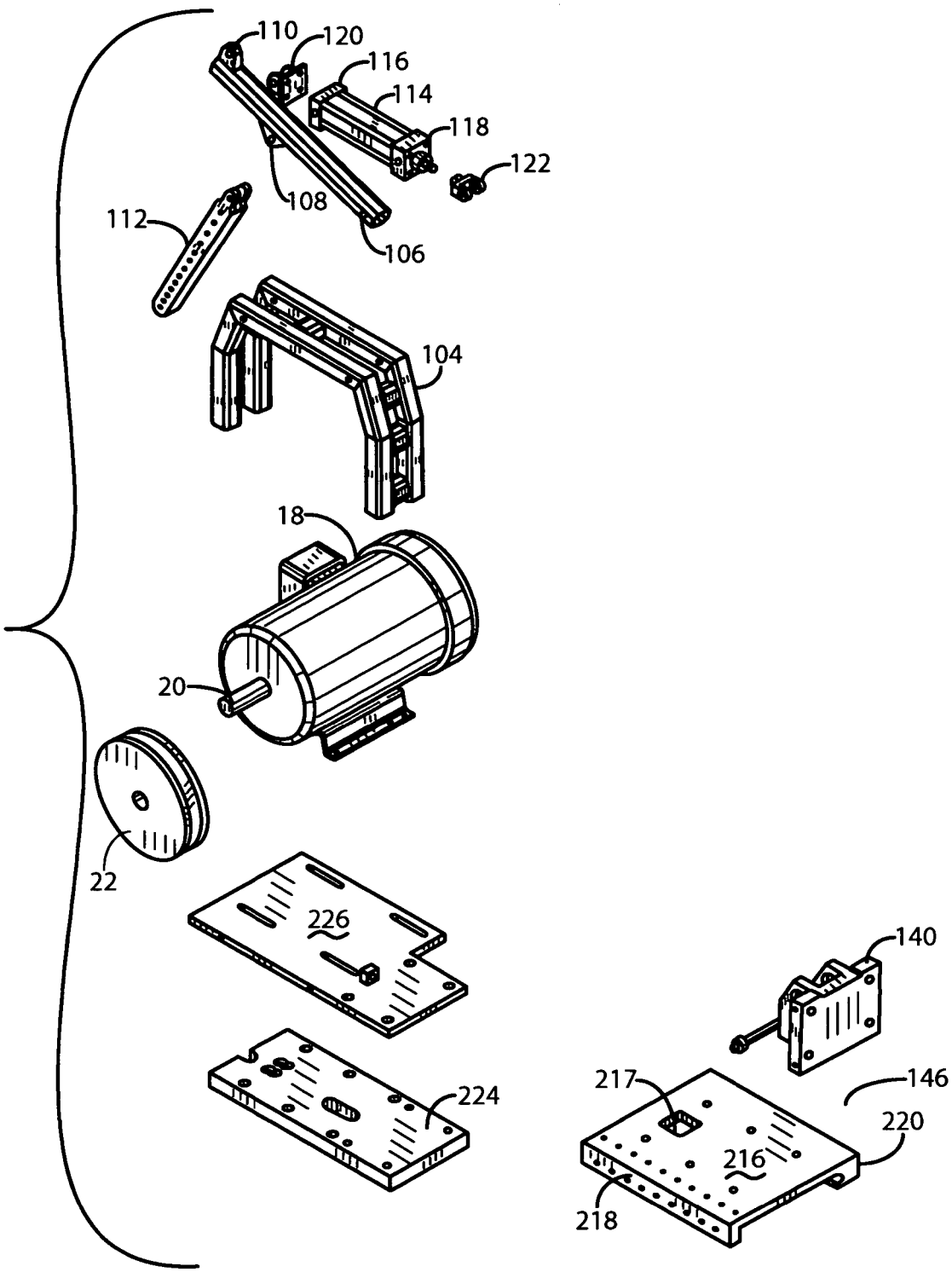

The present invention provides an apparatus for grinding a tire of a rotary kiln so to square the tire surface. As shown in FIG. 1, the tire grinder is generally designated by the numeral 10. The tire grinder 10 generally comprises a rotating grinding belt assembly 12 and a means for positioning the rotating grinding belt assembly against the out-of- round tire in a desired manner. The individual components of the tire grinder 10 are better shown in the exploded views of FIGS. 2, 3(*a*) and 3(*b*).

The rotating grinding belt assembly includes a drive assembly for rotating an endless grinding belt 16 and a frame assembly for urging the grinding belt 16 against the out-of-round tire. The drive assembly includes a drive motor 18 having a rotating motor shaft 20. The rotating motor shaft 20 is turns a first sheave 22. A second sheave 24 is attached to an arbor 26 at its first end 28 wherein rotation of the first sheave is transferred to the second sheave 24 by a V-belt which connects the first sheave to the second sheave 24. Arbor 26 has a second end 32 connected to an abrasive belt drive wheel 34 where rotation of the arbor 26 results in rotation of the drive wheel 34. The wheel 34 is knurled so that it provides greater traction against the inner surface of abrasive grinding belt 16. The grinding belt 16 is deployed about drive wheel 34 and an idler wheel 36. The shaft or arbor 26 is journaled by first and second pivot bushings 38 and 40 that fit into a first and second grinder head pivot collars 42 and 44 that bolt to frame structures yet to be described.

The frame assembly includes a grinding belt shield 46 (FIG. 1) for housing the grinding belt 16, a backing support assembly 48 for supporting the belt shield and a drive assembly shield 50 for housing the drive motor 18 and the V-belt drive for arbor 26. The abrasive belt shield 46 has a first and second sidewalls 52, 54, a backwall 56, a top wall 58 and a bottom wall 60 (FIG. 3(*a*)). The first side wall 52 is adapted to receive the drive assembly for rotating the grinding belt. For example, side wall 52 has a U-shaped recess 62 for receiving the arbor 26 therethrough. In addition, side wall 52 has circular aperture 64 and a plurality of notches designated by numeral 66. The belt shield 46 houses a platen backing plate 68 which cooperates with a platen plate 70 for supporting the grinding belt 16 against a planar surface when the grinding belt is brought into tangent relationship with the out-of-round tire.

The backing assembly 48 includes a main post 72. Said main post 72 has a rounded base opening 74 which arbor 26 passes through. The main post 72 is connected to the belt shield 46 by a plurality of tubes 76 which are connected to main post 72 and extend through the plurality of notches 66 in the first side wall 52 of the belt shield 46 and are there connected to the bracket plate 68 by screws (not shown). Bracket plate 68 is coupled to platen plate 70 and extends between tire wheel 34 and idler wheel 36.

Idler wheel 36 rotates on an axis arm 78, and axis arm 78 passes through circular aperture 64 of side wall 52. Axle arm 78 is then acted on by a belt tension arm 80 which has a perpendicularly extending ear 82 extending from a back surface of the belt tension arm 80. The perpendicular ear 82 is received in a tubular arm sheath 84 and is pivotally secured to the main post 72 between the upwardly extending connector poles 86 by pin 88 which passes through correspond apertures in poles 86 and arm sheath 84 thus connecting the belt tension arm 80 to the main post 72. Shaft retainers 90 lock pin 88 in position between the connector poles 86.

Occasionally, the grinding belt 16 may become misaligned and require adjustment to maintain the grinding belt 16 centered on friction roller 34 and idler roller 36. To that end, grinding belt position rod 92 is provided. It has a first end 94 and a second end 96. The belt position rod 92 passes through aperture 98 in side flange 100 which is welded to and extends from the main post 72. The first end 94 of positioning rod 92 is inserted into the bottom surface of grinding belt tension arm 80. When knob 102, which is disposed at second end 96 is turned, the first end 94 of belt positioning rod 92 interacts with axle arm 78, tilting axle arm 78 so that the grinding belt 16 is realigned.

The main post 72 is further supported by an A-frame back brace 104. A-frame back brace 104 has a backing bar bracket 106 which is operatively couple to the A-frame back brace. The backing bar bracket 106 has a bottom eyelet 108 and top eyelet 110. A back brace bracket 112 extends upward from the A-frame back brace bracket and it connects to backing bar bracket 106 at bottom eyelet 108. Back brace bracket 112 thus angles backing bar bracket 106. The A-frame backing brace 104 is further supported by head mount bracket 140 which is proximate to the main post 72. Said A-frame bracket 104 straddles the drive motor 18.

A first air cylinder 114 is provided having a first and second end 116, 118. A first air cylinder clevis 120 is coupled to first end 116 of the first air cylinder 114. The first air cylinder clevis 120 further connects to upper eyelet 110 of backing bar bracket 106. A further clevis 122 is coupled to the piston rod exiting the second end 118 of first air cylinder 114. The air cylinder rod piston clevis then connects to the main post 72 at a first backing eyelet 124 by a suitable pin. The first air cylinder 114 is used to maintain a constant pressure between the grinding belt 16 and the kiln tire. The first air cylinder 114 maintains heavy pressure initially against the kiln tire in order to grind out any humps in the kiln tire. The first air cylinder 114 can be de-energized once the kiln tire is squared up, and a relatively lower pressure can subsequently be used to remove grooves from the tire surface.

A second air cylinder 126 is provided having first and second ends 128, 130. Coupled to the first end 128 of the second air cylinder 126 is a clevis 132. The clevis 132 joins with a further clevis 134 which is attached to a distal end of arm sheath 84. A rod end clevis 136 is coupled to the second end 130 of the second air cylinder 126. The rod end clevis 136 cooperates with a second backing eyelet 138 of main post 72. The first air cylinder 114 functions to pivot the main post 72 forward about a horizontal axis of the arbor 26 and allow the grinding belt 16 to maintain a desired contact pressure with the kiln tire as the kiln is being rotated. The second air cylinder 126 is used to hold the idler wheel 36 at a first spacing from the drive wheel 34 such that the grinding belt will be taut during machining operations. When it is desired to replace a worn belt, the cylinder 126 is de-energized to reduce the spacing allowing the belt to be slipped off the rollers.

The means for positioning the rotating grinding belt assembly 14 includes a base plate member 142, a means for translating the rotating grinding belt assembly along an x-axis 144 and a means for translating the rotating grinding belt assembly along a y-axis 146. The means for translating the rotating grinding belt assembly along an x-axis 144 includes a linear mill mount 148 which is mounted on the base plate 142. The linear mill mount 148 has a first end 150, a second end 152, a first lengthwise side 154 and a second lengthwise side 156. A first guide rod 158 is affixed to the linear mill mount base 148 proximate the first length side 154 and a second guide rod 160 is likewise affixed proximate the second length side 156. A first x-axis feed bracket 162 is fastened to the first end 150 and a second x-axis feed bracket 164 is fastened to the second end 152 of the mill mount 148. A x-axis threaded feed screw 168 having first and second ends 170, 172 is journaled for rotation at its opposed ends in the first and second brackets 162, 164 by a first oil-impregnated flange bearing 174 disposed on the first end of the feed screw 170 and a second oil impregnated flange bearing 176 disposed on the second end 172 of the feed screw 168. The first oil impregnated flange bearing 174 is inserted into a first journal aperture 178 in the first x-feed bracket 162, and the second oil impregnated flange bearing 176 is inserted into the second journal aperture 180 in the second x-feed bracket 164.

A x-axis traveling nut 184 is operatively coupled to the x-axis feed screw 168. When the x-axis feed screw 168 is rotated, the traveling nut 184 is carried along the x-axis feed screw. The motion of the traveling nut 184 is therefore controlled by a servo motor (not shown) that attaches to bracket 164 via adaptor plate 186. An x-axis saddle 187 is coupled to the x-axis traveling nut 184 such that when the x-axis feed screw 168 is rotated, the x-axis traveling nut 184 carries the support plate 186 with it along the rails 158 and 160 over which the pillow blocks 188 are arranged to slide.

The means for translating the rotating guide belt assembly along an Y-axis 146 includes a y-axis mounting plate 190 which is affixed to the x-axis support plate 186. The y-axis mounting plate 190 has a first end 192, a second end 194 and a pair of lengthwise sides 196. The pair of lengthwise sides 196 are coupled to a pair of single edge slides 198*a* and 198*b*. An end bracket 200 is attached to the first end 192 of the y-axis mount plate 190. A y-axis threaded feed screw 202 having a first end 204 and a second end 206 is journaled for rotation in the bracket 200 and an oil impregnated flange bearing 210, which is also mounted on the first end 204 of the y-axis feed screw 202. The flange bearing 210 passes through journal aperture 211 and is in place by retainer cap 212.

A y-axis traveling nut 214 is operatively coupled to the y-axis feed screw 202. Cross-feed saddle 216 has a first and second side wall 218 and 220 and is mounted on y-axis mount plate 190 such that side wall 220 engages single edge slide 198A. Gib 222 engages single edge slide 198B and is further engaged by side wall 218 of cross saddle 216. Travel nut 214 fits into a square aperture 217 in the cross feed saddle 216 and is fastened to spacer plate 224 such that when the y-axis feed screw 202 is made to rotate, the y-axis traveling nut 214 carries the cross feed saddle and the spacer plate 224 along with it, allowing for translational movement of the cross feed saddle 216 and the spacer plate 224.

A motor mounting plate 226 is, in turn, mounted on the spacer plate 224. The drive motor 18 is bolted to the mounting plate 226.

To operate the kiln tire grinder 10, the operator first lines up the kiln tire grinding belt 16 against an out-of-round kiln tire to be machined by first moving the assembly 10 along the x-axis by rotating the x-axis feed screw 168 to carry x-axis saddle 186 side-to-side along the x-axis. To move the grinder belt assembly 10 forward, the operator then manipulates the y-axis feed screw 202 to translate the cross feed saddle 216 along the Y-axis, thus carrying the machine 10 towards the out-of-round tire. When the drive motor 18 is energized, the grinding belt is rotated at a speed such that when the grinding belt is forced against the out-of-round kiln tire, it is machined back into a flat peripheral surface.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A kiln tire grinding machine comprising, in combination:

(a) a frame base member;

(b) an arbor shaft journaled for rotation on the frame base member, the arbor shaft supporting a drive roller thereon;

(c) a frame post member having a first end supported by the arbor shaft and pivotable thereabout;

(d) an idler roller journaled for rotation about an idler shaft, the idler shaft being adjustably secured to a second end of the frame post member and with an endless abrasive belt adopted to be deployed about the drive roller and the idler roller;

(e) a motor operatively coupled to the arbor shaft for rotatably driving said arbor shaft;

(f) a first air actuated cylinder applying force to the frame post member to cause it to pivot the main post; and (g) a second air actuated cylinder controlling the spacing between the idler roller and the drive roller.

2. The kiln tire grinding machine as in claim 1 and further including a box-like shield supported by the frame post member and enclosing the drive roller and the idler roller on three sides.

3. The kiln tire grinding machine as in claim 1 and further including an A-frame member affixed to the frame base member, said first air actuated cylinder operatively disposed between the A-frame member and the frame post member.

4. The kiln tire grinding machine as in claim 1 and further including means for adjusting the spacing between the arbor shaft and the idler shaft.

5. The kiln tire grinding machine as in claim 4 wherein the adjusting means comprises an air cylinder operatively disposed between the idler shaft and the frame post member.

6. The kiln tire grinding machine as in any one of the claims 1–2 and 3–5 and further including:

(a) means for translating the frame base member along two mutually perpendicular axes.

* * * * *

UNITED STATES PATENT AND TRADEMARK OFFICE

CERTIFICATE OF CORRECTION

PATENT NO. : 6,949,009 B1
DATED : September 27, 2005
INVENTOR(S) : Martin A. Gardzinski and Donato L. Ricci It is certified that error appears in the above-identified patent and that said Letters Patent is hereby corrected as shown below:

Column 6,
Line 16, please change "adopted" to -- adapted --.

Signed and Sealed this

Twenty-second Day of November, 2005

JON W. DUDAS
*Director of the United States Patent and Trademark Office*